United States Patent [19]

Hedlund et al.

[11] 4,058,265

[45] Nov. 15, 1977

[54] CABLE MAGAZINE

[75] Inventors: Per Olov Hedlund, Norsborg; Lars Olof Hertsius, Bromma, both of Sweden

[73] Assignee: Telefonaktiebolaget L M Ericsson, Stockholm, Sweden

[21] Appl. No.: 682,094

[22] Filed: Apr. 30, 1976

[30] Foreign Application Priority Data

May 27, 1975 Sweden ..... 7506065

[51] Int. Cl.[2] ..... B65H 51/20

[52] U.S. Cl. ..... 242/47.01; 226/118; 242/47.5

[58] Field of Search ..... 242/47.01, 47.02, 47.03, 242/47.08, 47.09, 47.1, 47.11, 47.12, 47.13, 47.5, 25 R, 55.01, 54 R; 226/189, 118, 119

[56] References Cited

FOREIGN PATENT DOCUMENTS 538,927 4/1957 Canada ..... 242/47.5

*Primary Examiner*—Stanley N. Gilreath

*Attorney, Agent, or Firm*—Hane, Sullivan & Spiecens

[57] ABSTRACT

Cable magazine provided with two mainly parallel shafts on which sets of pulleys are arranged, and over which a cable is intended to be thread in several long and narrow coils, whereby one of the two sets of pulleys is stationary and the other one is movable and the sets of pulleys are intended to be moved away from each other when filling the cable magazine with cable and to be moved closer to each other when emptying the cable magazine of cables, which cable magazine is arranged with a mechanism for pulling the cables in form of a pulling wheel, against the periphery of which the cable is intended to be pressed and where said mechanism and the stationary set of pulleys are arranged on a common shaft.

3 Claims, 2 Drawing Figures

CABLE MAGAZINE

BACKGROUND OF THE INVENTION

The present invention relates to a cable magazine provided with two mainly parallel shafts on which sets of pulleys are arranged and over which a cable is intended to be thread in several long and narrow coils, whereby the sets of pulleys are intended to be moved away from each other when filling the cable magazine with cable and to be moved closer to each other when emptying the cable magazine of cable.

A phase of the manufacturing of cable usually is that the cable is covered with plastics, cooled and coiled on a cable drum. When exchanging a filled cable drum with an empty cable drum a break arises in the coiling, but no break is allowed in covering the cable; consequently cable is fed at unchanged speed during the exchange of drums as well. Between the arrangement for cooling the cable and the cable drums, a cable magazine is normally arranged and said cable magazine is intended to temporarily store the cable being fed during breaks in the coiling. Normally, a mechanism for pulling the cable forward is also arranged between the cooling arrangement and the cable magazine. The cable drums on to which the cable is coiled are actively rotated by a motor and consequently additional mechanisms for pulling the cable forward are unnecessary in this connection.

Cable magazines of this kind are generally known. Normally, such a magazine is provided with a set of free running pulleys on a stationary shaft and a similar set of pulleys on a second movable shaft. The loops of cable can be arranged vertically, horizontally or inclined between the two sets of pulleys. The number of pulleys in each set can be as many as 10 provided that the pulleys have a moderate diameter, and the largest distance between the centre of the pulleys can amount to 5 meters.

SUMMARY OF THE INVENTION

By the fact that the cable magazine according to the invention is provided with a mechanism for pulling the cable, a considerable simplification is achieved in the machinery for cable manufacturing, and the space for a special mechanism for pulling through cable is all together saved.

By the fact that the stationary set of pulleys is carried in bearings on the shaft supporting the mechanism for pulling the cable is achieved that the cable magazine gets a compact design so that its size increases only slightly due to the arrangement with the mechanism of pulling the cable. Said shaft supporting the wheel of the mechanism for pulling the cable and the stationary set of pulleys is driven from the the mechanism of pulling through cable. The wheel of the mechanism is permanently united with the shaft, while the pulleys are carried in bearings on the shaft in such a way that they have the possibility to rotate. By the fact that the shaft is rotated, the rotating motion of the pulleys carried on this is facilitated.

BRIEF DESCRIPTION OF THE DRAWING

Below an embodiment of a cable magazine according to the invention is described referring to the appended drawing, where.

DETAILED DESCRIPTION OF THE INVENTION

Figure 1:
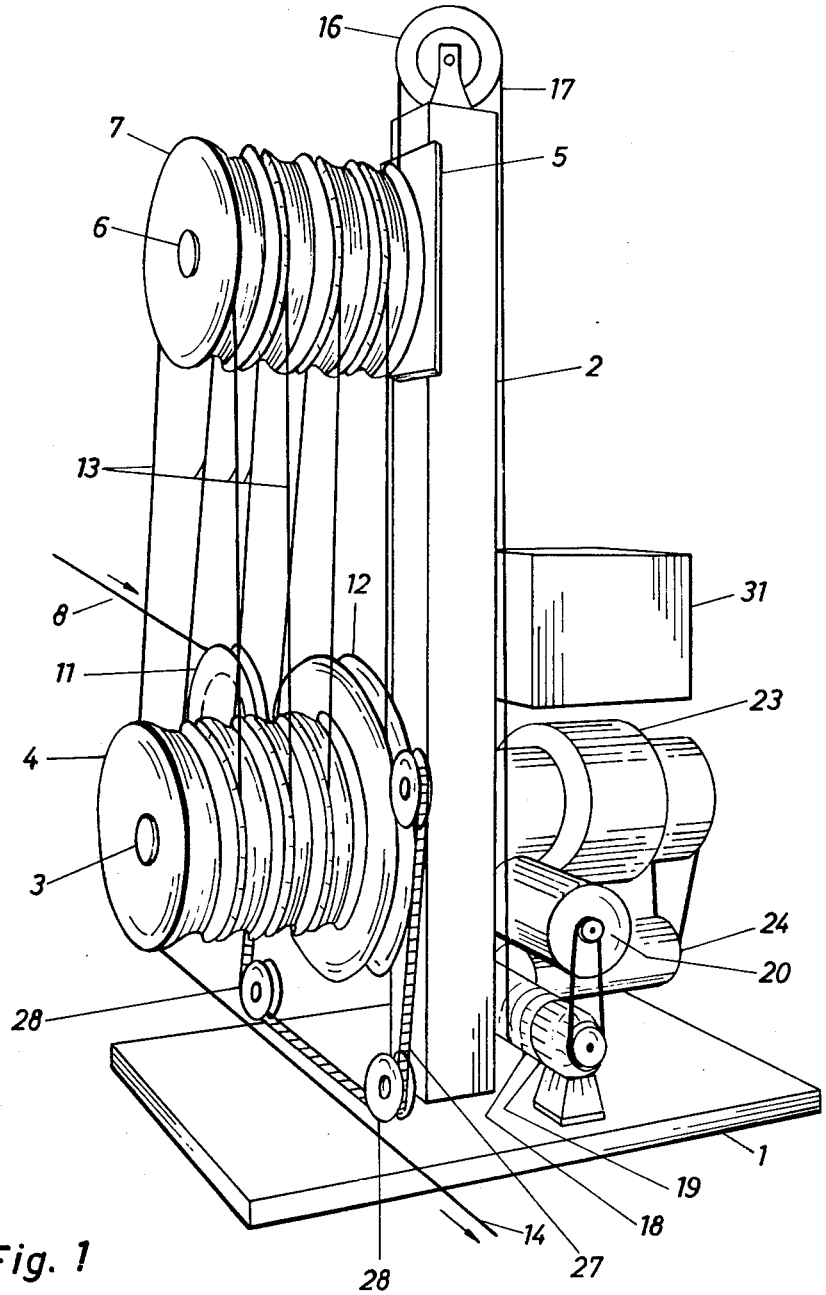
FIG. 1 shows a drawing in perspective of a cable magazine according to the invention.

As appears from FIG. 1, a vertical pillar 2 is placed on a base plate 1. The pillar supports a horizontal shaft 3 on which a number of pulleys 4 are carried, each having the possibility to rotate separately. A second shaft 6 is arranged above the first shaft 3 on a slide 5 that is movable along the pillar. On the second shaft there are as many pulleys 7 being carried as on the first shaft in such a way that each have the possibility to rotate separately. A cable 8 being continously fed is placed over a guide wheel 11 and a pulling wheel 12 arranged on the first shaft 3. Then the cable is placed in loops 13 between the pulleys on the first and second shaft and then fed from the cable magazine at a pulley on the first shaft 3. The slide 5 with the second shaft 6 is attached to a rope 17 which is placed over a pulley wheel 16. The rope is placed around a cable drum 18, which is connected to the lifting motor 20 by means of a gearing 19, a belt and belt disks.

The pulling wheel 12 is permanently united with the first shaft 3 which in its turn is connected to a driving motor 24 by means of an adjustable gearing 23 and a belt and belt disks.

In order to hold the cable coming to the cable magazine against the pulling wheel 12, a band 27 is placed around about half of the periphery of the pulling wheel, in this case around the lower part of the periphery of the wheel. The band is placed over four press rollers 28, three of which being visible on the drawing and the fourth is situated behind the pulley wheels 4.

Control equipment that is necessary for controlling the electric motors is placed in the control box 31.

Figure 2:
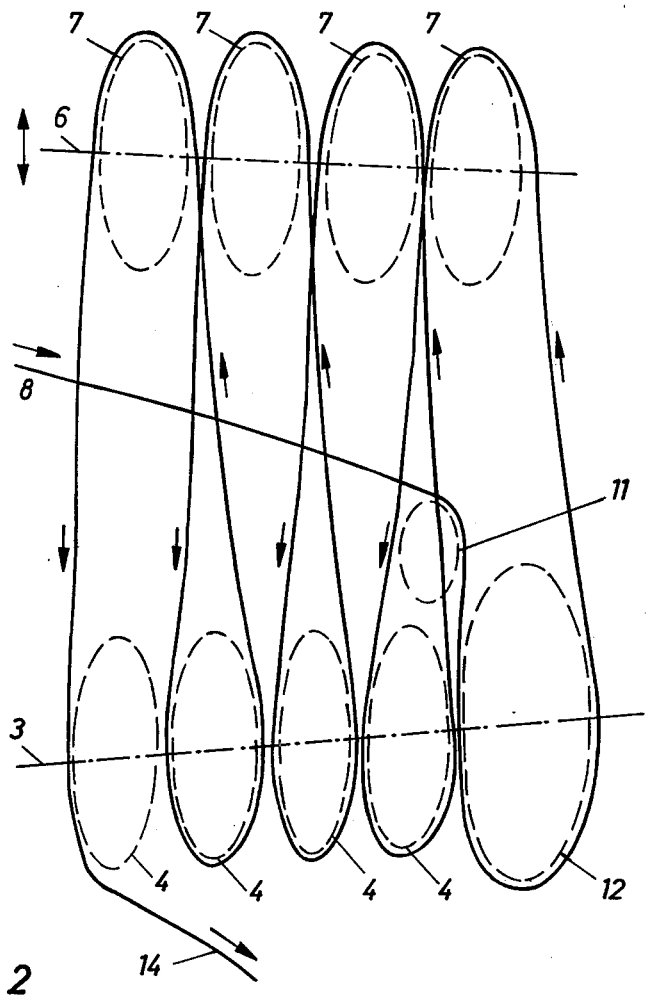
FIG. 2 shows how a cable is thread through the cable magazine.

When being used for cable manufacturing the cable magazine works in such a way that the cable coming in over the guide wheel 11 is pressed against the pulling wheel 12 by the band 27. Tension in the band is achieved by the fact that one of the press rollers 28 of the band keeps this stretched by means of a pressure arrangement not being shown on the drawing. Pulling force in the cable 8 being pulled forward is achieved by the driving motor 24 and the adjustable gearing 23 which rotates the shaft 3 on to which the pulling wheel 12 is attached in such a way that it follows the shaft 3 in its rotation. Generally the arrangement cannot influence the speed with which the cable is pulled through as the speed is determined by the procedure of manufacturing the cable, but the pulling tension in the cable being pulled through is determined by the torque the motor 24 is adjusted to and by the adjusting of the gearing 23. After the pulling wheel 12, the cable is placed in loops by turns across a pulley 7 on the second shaft 6 and across a pulley 4 on the first shaft 3 in a way shown in FIG. 2.

The speed with which the cable end 14 is fed out of the magazine is determined by the subsequent manufacturing procedure; the speed may vary. When the speed of the cable going into the cable magazine equals the speed coming out of the cable magazine the magazine contains a constant length of cable and the movable second shaft 6 then takes an unchangeable position.

When the speed of the cable coming out from the magazine is lower than the speed going into the magazine its contents of cable must increase. This is effectuated by the fact that both sets of pulleys are separated, that is in this case that the second set of pulleys 7 is elevated by influence of the lifting motor 20 on the rope 17 and the slide 5. The pulling tension in the cable 14 coming out from the cable magazine is determined by the pulling tension of the rope 17 and in the last place by the torque of the lifting motor 20. As the motor 20 is fed with current in order to develop a torque but most frequently is standing still, special arrangements for cooling are added to this motor.

In the example of a cable magazine being shown in FIG. 1, the pillar has a height of 2.7 meters and each set of pulleys contains four pulleys with a diameter of 300 mm. Cable magazines with other dimensions as well and with slightly different design of the pulleys are covered by the invention. The design of the pulleys depends on the treated cable; the smaller the diameter of the cable the smaller the diameter of the pulleys and the greater the number of them.

We claim:

1. In a cable magazine comprising a first shaft and a second shaft spaced parallelly from said first shaft, said first shaft having rotatably mounted thereabout a plurality of pulleys and said second shaft also having rotatably mounted thereabout a plurality of pulleys, said second shaft and its associated plurality of pulleys being movable relative to said first shaft and its associated plurality of pulleys to thereby vary the distance between said shafts in accordance with the amount of cable being stored in said magazine, the improvement comprising: a grooved pulling wheel affixed to said first shaft for pulling cable into said cable magazine, and driving means connected to said first shaft for rotating said first shaft and said pulling wheel affixed thereto, said pulling wheel being affixed to said first shaft such that said plurality of pulleys of said first shaft are all positioned on one side of said pulling wheel, whereby loops of cable are formed between the plurality of pulleys on said first shaft and the plurality of loops on said second shaft.

2. The improvement according to claim 1, wherein said driving means comprises an electric motor and gear means connecting said electric motor to said first shaft, said pulling wheel being positioned on said first shaft between said plurality of pulleys of said first shaft and said electric motor and gear means.

3. The improvement according to claim 1, wherein said pulling wheel comprises a band surrounding approximately half of the circumference of the groove of said grooved pulling wheel, and a plurality of press rollers for spacing the band about the groove.

* * * * *